US007654650B2

(12) United States Patent
Hibi

(10) Patent No.: US 7,654,650 B2
(45) Date of Patent: Feb. 2, 2010

(54) INK-JET HEAD

(75) Inventor: Manabu Hibi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 431 days.

(21) Appl. No.: 11/620,802

(22) Filed: Jan. 8, 2007

(65) Prior Publication Data

US 2007/0159513 A1 Jul. 12, 2007

(30) Foreign Application Priority Data

Jan. 10, 2006 (JP) ..... 2006-002699

(51) Int. Cl.
*B41J 2/045* (2006.01)

(52) U.S. Cl. ..... 347/68

(58) Field of Classification Search ..... 347/68, 347/69–72

See application file for complete search history.

(56) References Cited

U.S. PATENT DOCUMENTS

2005/0036017 A1 2/2005 Chikamoto et al.

FOREIGN PATENT DOCUMENTS

| | | | |
|---|---|---|---|
| EP | 1403053 | A1 | 3/2004 |
| EP | 1493578 | A1 | 1/2005 |
| EP | 1629981 | A1 | 3/2006 |
| JP | 2005059436 | A | 3/2005 |

OTHER PUBLICATIONS

European Patent Office, European Search Report for European Patent Application No. 07000137.5 (counterpart to above-captioned patent application), dated Oct. 30, 2008.

*Primary Examiner*—K. Feggins
(74) *Attorney, Agent, or Firm*—Baker Botts, LLP

(57) ABSTRACT

An ink-jet head includes a passage unit in which a common ink chamber and individual ink passages are formed, and an actuator unit fixed to the passage unit. A closed passage having a shape of the individual ink passage being partially closed is formed in the passage unit.

21 Claims, 12 Drawing Sheets

INK-JET HEAD

BACKGROUND OF THE INVENTION

1. Field of the Invention

The present invention relates to an ink-jet head that ejects ink to a recording medium.

2. Description of Related Art

Japanese Patent Unexamined Publication No. 2005-59436 discloses an ink-jet head including a passage unit in which formed are individual ink passages each extending from an outlet of a common ink chamber through a pressure chamber to an ink ejection port. Four actuator units are bonded to an upper face of the passage unit. Each of the actuator units has a trapezoidal shape in a plan view, and the four actuator units have the same shape. Each of the actuator units has four piezoelectric layers laminated to each other. Only uppermost one of the four piezoelectric layers acts as an active layer sandwiched between a common electrode and individual electrodes. The individual ink passages are regularly formed only in regions of the passage unit opposed to the respective actuator units.

SUMMARY OF THE INVENTION

In the ink-jet head disclosed in the above-mentioned Publication, pressure chambers that are opposed to one actuator unit are regularly arranged in a matrix, that is, in two directions. As a result, one pressure chamber group opposed to one actuator unit is formed. In the same manner, one individual ink passage group opposed to one actuator unit is formed. In the individual ink passage group, any of individual ink passages except ones located outermost is surrounded by other six individual ink passages in the same pattern. On the other hand, each of the individual ink passages located outermost in the individual ink passage group is merely partially surrounded by other two to four individual ink passages, because no individual ink passages are formed on an outside thereof. The individual ink passage is in the form of a cavity. Therefore, a region of the passage unit surrounding an individual ink passage is reduced in rigidity as the number of other individual ink passages formed in the region increases. Ink ejection performance such as an ink ejection speed, an ink ejection direction, an ink ejection amount, and the like can be considered to depend on rigidity of regions surrounding an individual ink passage. Accordingly, ink ejection performance exhibited by the individual ink passages located outermost is different from ink ejection performance exhibited by the other individual ink passages. That is, ink ejection performance of an individual ink passage varies depending on where the individual ink passage is located.

An object of the present invention is to provide an ink-jet head that can suppress variation in ink ejection performance of an individual ink passage depending on where the individual ink passage is located.

According to an aspect of the present invention, there is provided an ink-jet head including a passage unit and an actuator unit. In the passage unit, formed are a common ink chamber and a plurality of individual ink passages each extending from an outlet of the common ink chamber through a pressure chamber to an ink ejection port. The actuator unit is fixed to a plane defined by a surface of the passage unit and gives ejection energy to ink in the pressure chamber. A closed passage having a shape of the individual ink passage being partially closed is formed in the passage unit.

In the aspect, the closed passage is formed in the passage unit. This can reduce variation in rigidity among regions surrounding the respective individual ink passages, consequently reducing variation in ink ejection performance among individual ink passages depending on locations of the individual ink passages. In addition, forming the closed passage leads to prevention of waste of ink. Further, there can be prevented occurrence of ink ejection failure which may otherwise be caused by air bubbles entering the individual ink passage through the closed passage.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
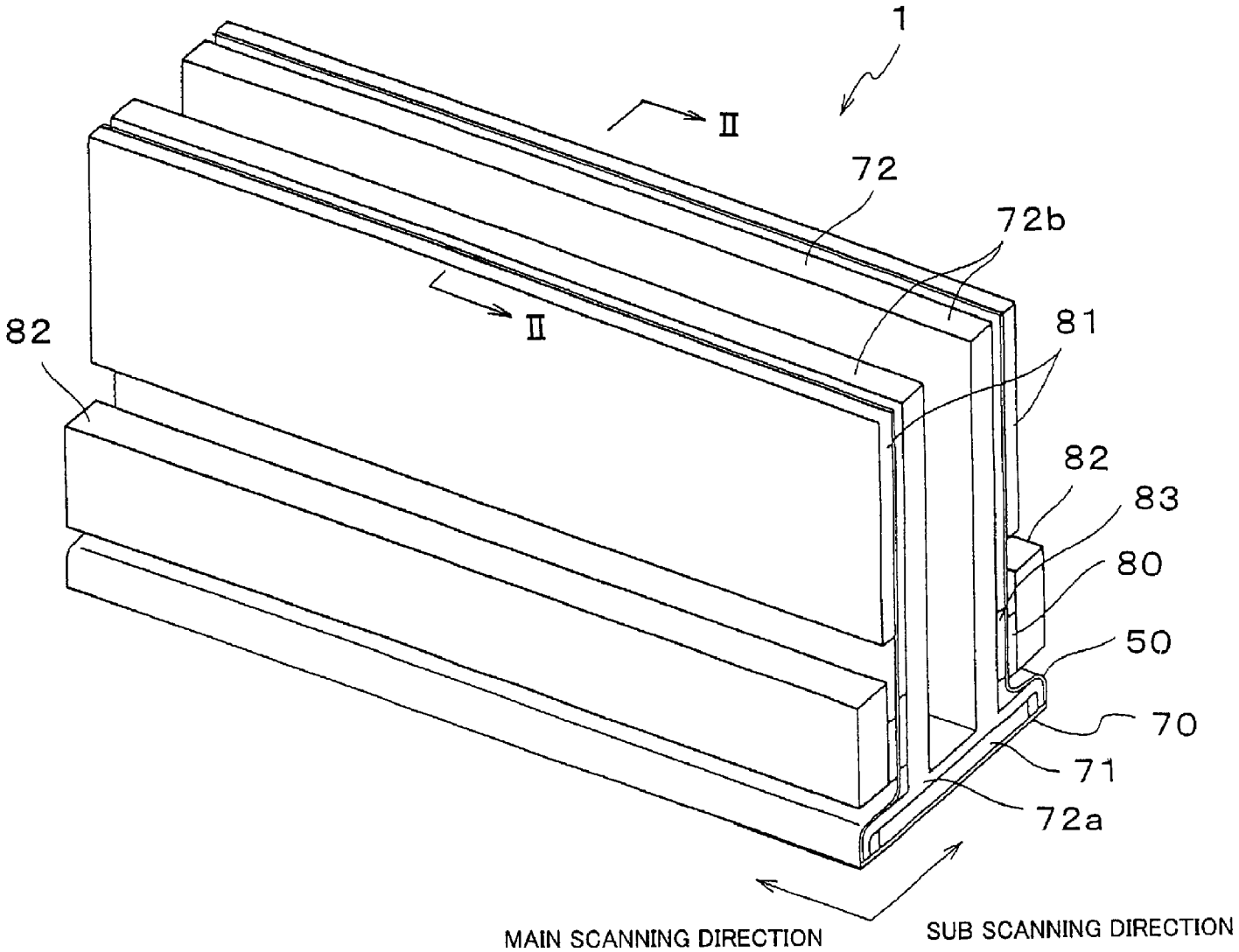
FIG. 1 is a perspective view of an external appearance of an ink-jet head according to a first embodiment of the present invention.
Figure 2:
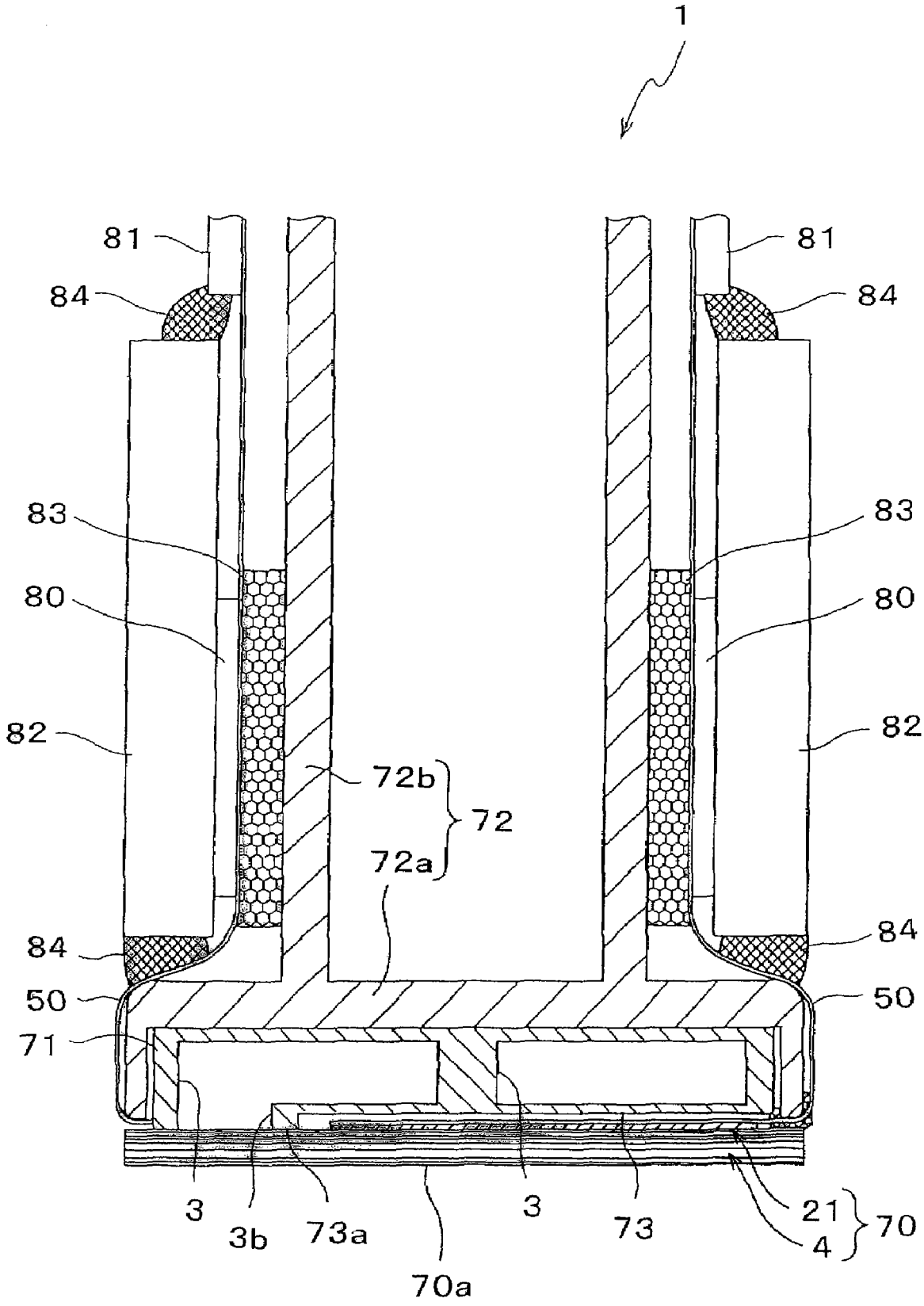
FIG. 2 is a sectional view taken along line II-II shown in FIG. 1.

First, an ink-jet head according to a first embodiment of the present invention will be described. FIG. 1 is a perspective view of an external appearance of an ink-jet head according to a first embodiment of the present invention. FIG. 2 is a sectional view taken along line II-II shown in FIG. 1. As shown in FIG. 1, an ink-jet head 1 includes a head main body 70 and a base block 71. The head main body 70 ejects ink to a paper acting as a recording medium. The base block 71 is disposed above the head main body 70, and has two ink reservoirs 3 formed therein. The ink-jet head 1 of this embodiment is fixed to a recording apparatus such as a line-type ink-jet printer, in such a manner that a widthwise direction of the ink-jet head 1 which means a sub scanning direction is in parallel with a paper conveyance direction.

As shown in FIG. 2, the head main body 70 includes a passage unit 4 in which an ink passage is formed. The passage unit 4 is constructed of thin plates laminated and bonded to each other. A bottom face of the head main body 70 serves as an ink ejection face (ejection face) 70*a* on which formed are many openings of nozzles (ink ejection ports) 8 each having a small diameter (see FIG. 5A).

Figure 3:
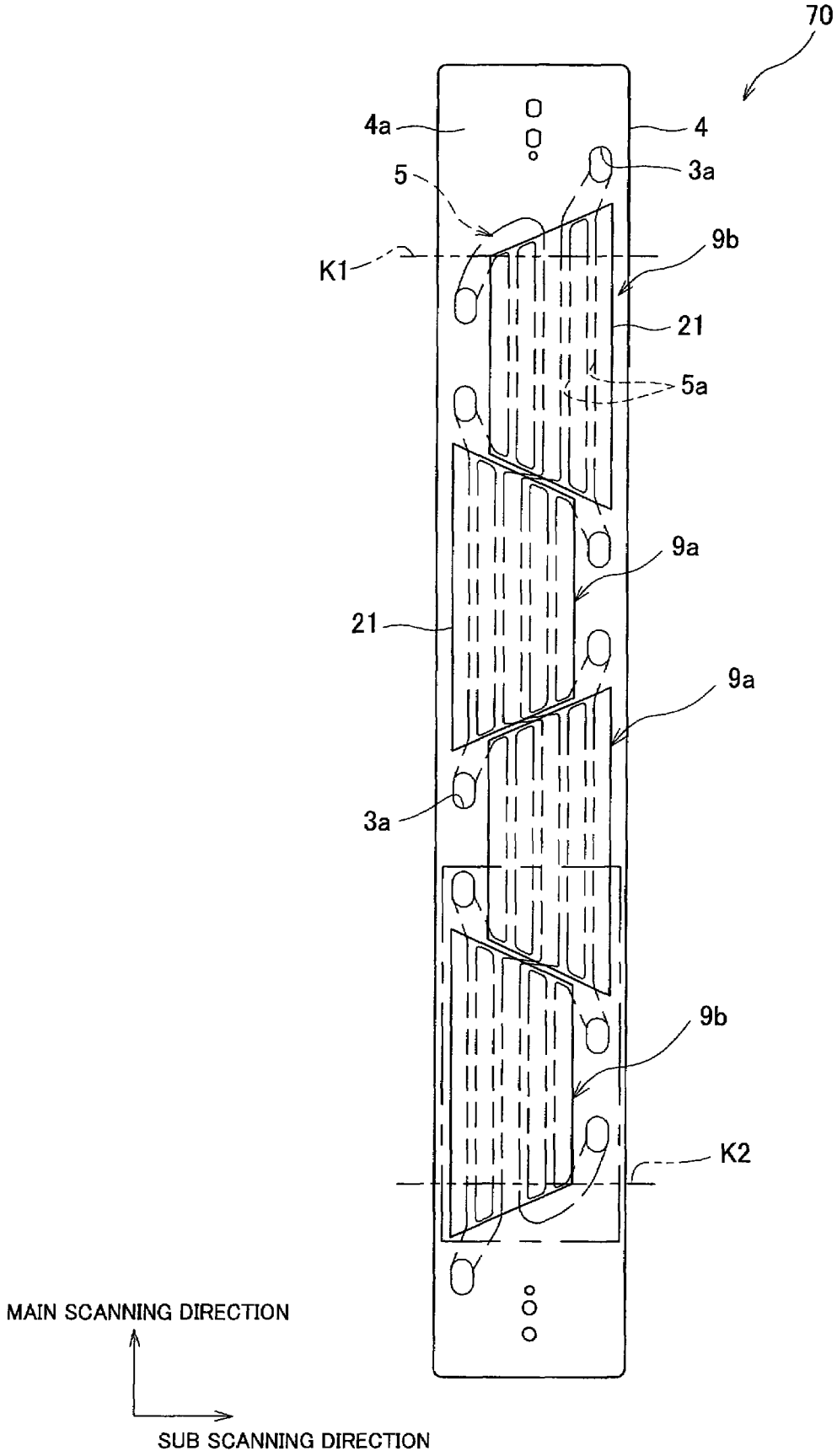
FIG. 3 is a plan view of a head main body as seen from above.

FIG. 3 is a plan view of the head main body 70 as seen from above. In a plan view, the passage unit 4 has a rectangular shape elongated in its longitudinal direction, that is, in a main scanning direction. In FIG. 3, manifold channels 5 which are provided inside the passage unit 4 are illustrated with broken lines. Ten openings 3*a* are formed on an upper face of the passage unit 4. The ten openings 3*a* are arranged in two rows along the longitudinal direction of the passage unit 4, with each row including five openings 3*a*. Each of the openings 3*a* is connected to the manifold channel 5*a*. In addition, the openings 3*a* are connected to the ink reservoirs 3 of the base block 71. Within the passage unit 4, each manifold channel 5 branches into several sub manifold channels 5*a*. Each of the sub manifold channels 5*a* extends in parallel to the longitudinal direction of the passage unit 4. Thus, ink stored in the ink reservoirs 3 of the base block 71 goes through the openings 3*a* into the manifold channels 5 from which the ink is distributed to the respective sub manifold channels 5*a* each acting as a common ink chamber.

Four actuator units 21 having the same shape are bonded to the upper face of the passage unit 4 with an epoxy-based thermosetting adhesive, in such a manner that the actuator units 21 keep away from the openings 3*a*. In a plan view, each of the actuator units 21 has a trapezoidal shape with two acute angles, and is substantially laterally symmetrical. The four actuator units 21 are disposed with their parallel opposed sides, which mean shorter sides and longer sides, extending along the longitudinal direction of the passage unit 4. The four actuator units 21 are arranged substantially in a line along the longitudinal direction while center positions of the respective actuator units 21 are alternately and equidistantly shifted with respect to a widthwise direction of the passage unit 4. To be more specific, the four actuator units 21 are arranged in a zigzag pattern along the longitudinal direction of the passage unit 4. Neighboring ones of the four actuator units 21 are oriented in directions 180 degrees apart from each other. Accordingly, except for outermost two oblique sides, an oblique side of one actuator unit 21 is adjacent and in parallel to an oblique side of another actuator unit 21 neighboring to the one actuator unit 21. The two adjacent parallel oblique sides are partially within the same range with respect to the longitudinal direction. That is, the two adjacent parallel oblique sides partially overlap each other with respect to the longitudinal direction.

Referring to FIG. 1 again, a flexible printed circuit (FPC) 50 acting as a wire member is bonded to an upper face of each actuator unit 21. The FPC 50 extends leftward or rightward, and then extends upward while being bent, as shown in FIG. 2.

On the upper face of the passage unit 4, two pressure chamber groups 9*a* and two pressure chamber groups 9*b* are provided. The pressure chamber group 9*a* has a trapezoidal shape of substantially the same size as a size of the actuator unit 21. The pressure chamber group 9*b* has a trapezoidal shape with two corners thereof being right-angled. The trapezoidal shape of the pressure chamber group 9*b* corresponds to a portion of the actuator unit 21 except an outer region 17 which will be described later. The four pressure chamber groups 9*a* and 9*b* are arranged substantially in a line along the longitudinal direction. The two pressure chamber groups 9*a* are sandwiched between the two pressure chamber groups 9*b*. Any of the pressure chamber groups 9*a* and 9*b* is made up of many pressure chambers 10 arranged in a matrix (see FIG. 4). Each of the pressure chamber groups 9*a* and 9*b* is covered with the actuator unit 21. In other words, each actuator unit 21 has such a size as to cover the many pressure chambers 10 that constitute the pressure chamber group 9*a* or 9*b*. The above-described manifold channel 5 extends along between neighboring actuator units 21, and the sub manifold channels 5*a* branching therefrom are disposed in a region corresponding to where the pressure chamber group 9*a* or 9*b* exists.

Referring to FIG. 2 again, the base block 71 is made of a metal material such as stainless steel. The ink reservoir 3 formed in the base block 71 is a hollow region of substantially rectangular parallelepiped shape that extends along the longitudinal direction of the base block 71. Ink is supplied from an unillustrated ink tank to the ink reservoirs 3 which are thereby always filled up with ink. The ink reservoirs 3 have a total of ten openings 3*b* from which ink flows out. The ten openings 3*b* are arranged in two rows along a longitudinal direction of the ink reservoirs 3. The openings 3*b* are located at positions corresponding to the respective openings 3*a* of the passage unit 4. That is, in a plan view, the ten openings 3*b* of the ink reservoirs 3 and the ten openings 3*a* of the passage unit 4 are arranged to have the same positional relation.

In a lower face 73 of the base block 71, a portion 73*a* in the vicinity of each opening 3*b* protrudes downward lower than its surroundings. Only at the portion 73*a* of the lower face 73 in the vicinity of each opening 3*b*, the base block 71 is in contact with a portion of the upper face of the passage unit 4 in the vicinity of each opening 3*a*. Accordingly, a region of the base block 71 other than the portion 73*a* in the vicinity of each opening 3*b* is spaced apart from the head main body 70. In a space thus formed, the actuator units 21 are disposed.

A holder 72 includes a support portion 72*a* and a pair of protruding portions 72*b*. The support portion 72*a* holds the base block 71. The protruding portions 72*b* are disposed at an interval from each other with respect to the sub scanning direction, and protrude upward from an upper face of the support portion 72*a*. The base block 71 is bonded and fixed within a concavity that is formed in a lower face of the support portion 72*a* of the holder 72. Each of the FPCs 50 connected to the actuator units 21 is disposed so as to extend along a surface of the protruding portion 72*b* of the holder 72 with an elastic member such as a sponge therebetween. A driver IC 80 is mounted on the FPC 50. The FPC 50 transmits a drive signal outputted from the driver IC 80, to the actuator unit 21 of the head main body 70. The FPC 50 is electrically bonded to the actuator unit 21 and the driver IC 80 with solder or the like.

A heat sink 82 is disposed in close contact with an outer surface of the driver IC 80. The heat sink 82 dissipates heat that is generated in the driver IC 80. A substrate 81 to which one end of the FPC 50 is connected is disposed above the driver IC 80 and the heat sink 82. An upper face of the heat sink 82 is bonded to the substrate 81 with a seal member 84. Also, a lower face of the heat sink 82 is bonded to the FPC 50 with a seal member 84. Dust and ink are thereby prevented from entering a main body of the ink-jet head 1.

Figure 4:
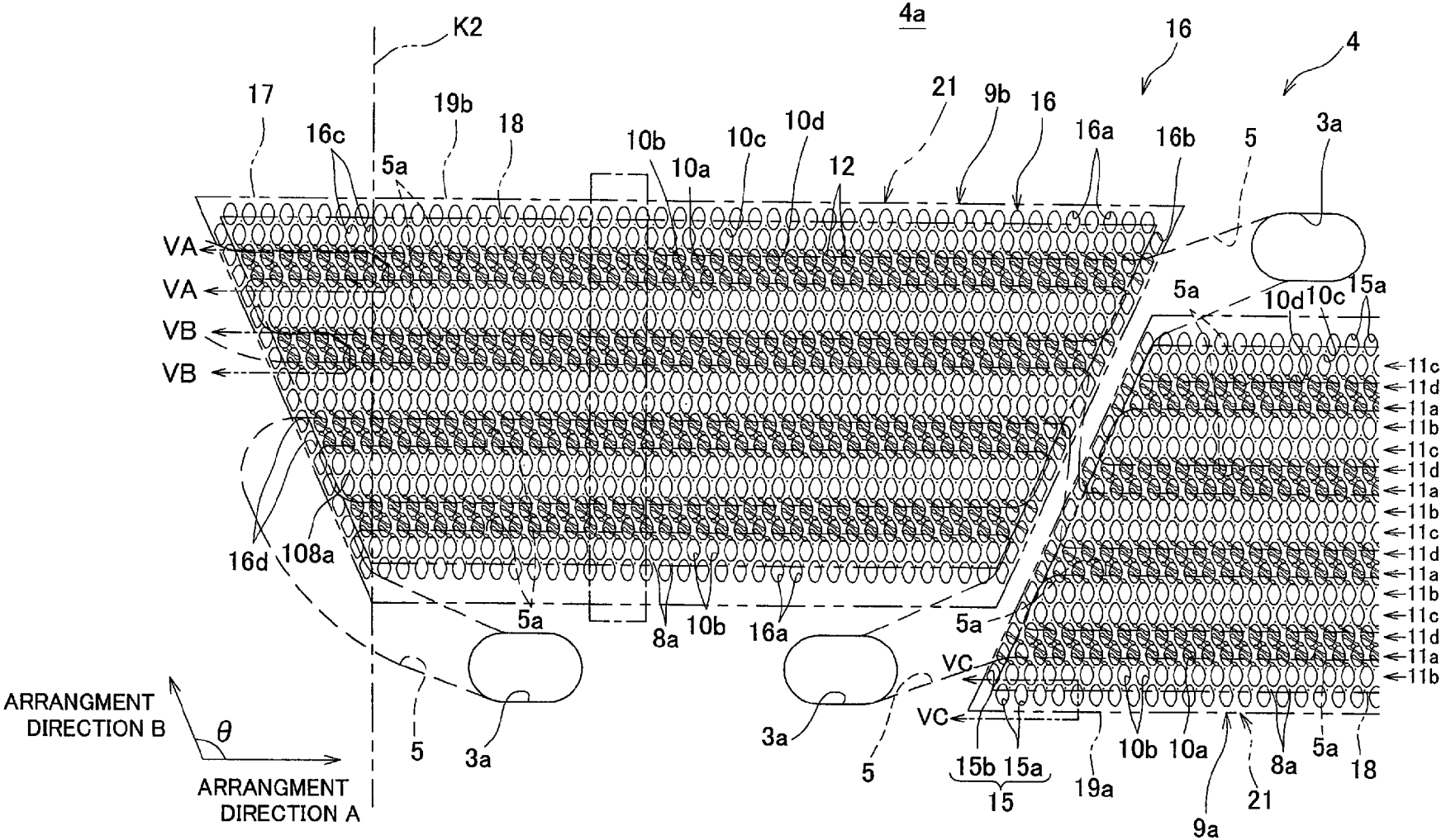
FIG. 4 shows on an enlarged scale a region enclosed with an alternate long and short dash line in FIG. 3.

FIG. 4 shows on an enlarged scale a region enclosed with an alternate long and short dash line in FIG. 3. As shown in FIG. 4, four sub manifold channels 5*a* extend in a region within the passage unit 4 opposed to the actuator unit 21. Many individual ink passages 7 each extending to each nozzle 8 (see FIG. 5A) are connected to each of the sub manifold channels 5*a*. In FIG. 4, for the purpose of easy understanding, actuator units 21 are illustrated with broken lines though they should be illustrated with solid lines, while ink ejection ports 8*a*, pressure chambers 10, apertures 12, cavities 16*a* and the like, which actually should be illustrated with broken lines, are illustrated with solid lines.

The pressure chamber groups 9*a* and 9*b* formed on an upper face 4*a* of the passage unit 4 are made up of many pressure chambers 10 each having a substantially rhombic shape in a plan view. Recesses formed on the upper face 4*a* of the passage unit 4 is closed with the actuator units 21, so that the pressure chambers 10 are defined. The pressure chamber 10 has a substantially rhombic shape in a plan view. Each pressure chamber 10 included in the pressure chamber groups 9*a* and 9*b* has one end thereof with respect to a longer diagonal communicating with a nozzle 8 and the other end thereof with respect to the longer diagonal communicating with a sub manifold channel 5*a* through an aperture 12 acting as a throttle.

Here, this embodiment will be described with reference to two imaginary planes K1 and K2 that extend in the sub scanning direction and perpendicularly cross the upper face 4*a* of the passage unit 4. The imaginary planes K1 and K2 are illustrated with alternate long and two short dashes lines in FIGS. 3 and 4. Regions that are, in a plan view, enclosed by contours of the respective actuator unit 21 and in addition existing between the two imaginary planes K1 and K2 are active regions in which individual ink passages 7 involved in image forming are provided. In this embodiment, each of the imaginary planes K1 and K2 passes through an outer obtuse-angle vertex of each of the two outermost actuator units 21 which mean the two actuator units 21 not sandwiched between the other two actuator units 21 neighboring thereto.

As shown, the active regions include active regions 19*a* and active regions 19*b*. In a plan view, the active regions 19*a* are trapezoidal regions each having the same shape as that of the actuator unit 21 and each enclosed by the contour of each of the two inner actuator units 21 which mean the two actuator units 21 sandwiched between the other two actuator units 21 neighboring thereto. Individual ink passages 7 provided in relation to the pressure chamber groups 9*a* are formed in the active regions 19*a*. The active regions 19*b* are trapezoidal regions each having two right angles. The active regions 19*b* exist inside the imaginary planes K1 and K2, and in addition each of the active regions 19*b* is enclosed by the contour of each of the two outer actuator units 21 in a plan view. Individual ink passages 7 provided in relation to the pressure chamber groups 9*b* are formed in the active regions 19*b*.

In the pressure chamber groups 9*a* and 9*b*, as shown in FIG. 4, pressure chambers 10 constituting the respective groups are regularly and adjacently arranged in a matrix in two directions, that is, in an arrangement direction A and an arrangement direction B. The arrangement direction A is the longitudinal direction of the passage unit 4, and extends in parallel to a shorter diagonal of the pressure chamber 10. The arrangement direction B is in parallel to one oblique side of the pressure chamber 10 forming an obtuse angle with the arrangement direction A. In each of the pressure chamber groups 9*a* and 9*b*, one pressure chamber 10 is surrounded by six other pressure chambers 10. In addition, with respect to the arrangement direction A, the pressure chambers 10 are spaced apart from each other at intervals corresponding to 37.5 dpi, while with respect to the arrangement direction B sixteen pressure chambers 10 at the maximum are arranged. That is, the pressure chambers 10 are regularly arranged at fixed intervals along the arrangement direction A to thereby form pressure chamber rows 11, and sixteen pressure chamber rows 11 are arranged in parallel to each other to thereby form each pressure chamber group 9*a*, 9*b*. As a result of the pressure chambers 10 being arranged in this way, an image can be formed at a resolution of 600 dpi as a whole.

The number of pressure chambers 10 included in each pressure chamber row 11 decreases as the pressure chamber row 11 gets closer from the longer side to the shorter side of the actuator unit 21. Consequently, a contour of the pressure chamber group 9*a* which means a contour of the active region 19*a* is a trapezoidal shape of substantially the same size as that of the actuator unit 21. On the other hand, a contour of the pressure chamber group 9*b* has a shape of "trapezoidal with two right angles" that is enclosed by the contour of the actuator unit 21 and the imaginary plane K1 or K2.

The pressure chamber rows 11 are, depending on their position relative to the sub manifold channels 5*a* as seen in the direction perpendicularly crossing the drawing sheet of FIG. 4, classified into first pressure chamber rows 11*a*, second pressure chamber rows 11*b*, third pressure chamber rows 11*c*, and fourth pressure chamber rows lid. The first to fourth pressure chamber rows 11*a* to lid are arranged periodically in an order of 11*c*, 11*d*, 11*a*, 11*b*, 11*c*, 11*d*, . . . 11*b* from the shorter side to the longer side of the actuator unit 21.

When seen in the direction perpendicularly crossing the drawing sheet of FIG. 4, ink ejection ports 8*a* corresponding to pressure chambers 10*a* included in the first pressure chamber rows 11*a* and ink ejection ports 8*a* corresponding to pressure chambers 10*b* included in the second pressure chamber rows 11*b* are concentrated at a lower side in FIG. 4 with respect to the direction perpendicular to the arrangement direction A. Each of the ink ejection ports 8*a* is opposed to a lower end portion of its corresponding pressure chamber 10. Ink ejection ports 8*a* corresponding to pressure chambers 10*c* included in the third pressure chamber rows 11*c* and ink ejection ports 8*a* corresponding to pressure chambers 10*d* included in the fourth pressure chamber rows lid are concentrated at an upper side in FIG. 4 with respect to the direction perpendicular to the arrangement direction A. Each of the ink ejection ports 8*a* is opposed to an upper end portion of its corresponding pressure chamber 10. When seen in the direction perpendicularly crossing the drawing sheet of FIG. 4, not less than half an area of each of the pressure chambers 10*a* and 10*d* included in the first and fourth pressure chamber rows 11*a* and 11*d* overlaps the sub manifold channel 5*a*. When seen in the direction perpendicularly crossing the drawing sheet of FIG. 4, a substantially entire area of each of the pressure chambers 10*b* and 10*c* included in the second and third pressure chamber rows 11*b* and 11*c* does not overlap the sub manifold channel 5*a*. In this way, a width of a sub manifold channel 5*a* can be enlarged as wide as possible in order to smoothly supply ink to respective pressure chambers 10, while preventing the sub manifold channel 5*a* from overlapping nozzles 8 that communicate with pressure chambers 10 included in any of the pressure chamber rows 11.

A peripheral cavity group 15 that encloses the pressure chamber group 9*a* is formed in a region of the upper face 4*a* of the passage unit 4 opposed to each of the two inner actuator units 21. Cavities included in the peripheral cavity group 15 are, like the pressure chambers 10, defined by recesses formed on the upper face 4*a* of the passage unit 4 being closed with the actuator unit 21. The peripheral cavity group 15 includes two kinds of cavities, that is, cavities 15*a* and cavities 15*b*. The cavities 15*a* are arranged in a line along each of the long and shorter sides of the actuator unit 21. The cavity 15*a* has the same shape and size as those of the pressure chamber 10. The cavities 15*b* are arranged in a line along each oblique side of the actuator unit 21. The cavity 15*b* has substantially the same shape and size as those of the pressure chamber 10. As will be described later, the cavity 15*a* constitutes a closed passage 55 that is in the shape of the individual ink passage 7 being partially closed (see FIG. 5C). The cavity

15*a* as well constitutes a closed passage that is in the shape of the individual ink passage 7 being partially closed.

A peripheral cavity group 16 that encloses the pressure chamber group 9*b* is formed in a region of the upper face 4*a* of the passage unit 4 opposed to each of the two outer actuator units 21. Cavities included in the peripheral cavity group 16 are, like the pressure chambers 10, defined by recesses formed on the upper face 4*a* of the passage unit 4 being closed with the actuator unit 21. The peripheral cavity group 16 includes four kinds of cavities, that is, cavities 16*a*, cavities 16*b*, cavities 16*c*, and cavities 16*d*. The cavities 16*a* are arranged in a line along each of the long and shorter sides of the actuator unit 21. The cavity 16*a* has the same shape and size as those of the pressure chamber 10. The cavities 16*b* are arranged in a line along an inner oblique side of the actuator unit 21. The cavities 16*d* are arranged in a line along an outer oblique side of the actuator unit 21. Each of the cavities 16*b* and 16*d* has substantially the same shape and size as those of the pressure chamber 10. The cavities 16*c* are arranged in a region (hereinafter referred to as an outer region 17) that is, in a plan view, enclosed by the contour of each of the two outer actuator units 21 and in addition located outside the active region 19*b* which means outside the imaginary plane K1 or K2. In an area within the outer region 17 surrounded by the row of cavities 16*a*, the row of cavities 16*d*, and the imaginary plane K1 or K2, the cavities 16*c* are arranged continuously with the pressure chamber group 9*b* in the same pattern as that of the pressure chambers 10 included in the pressure chamber group 9*b*. The cavity 16*c* has the same shape and size as those of the pressure chamber 10. As will be described later, the cavity 16*c* is a part of a closed passage that is in the shape of the individual ink passage 7 being partially closed (see FIG. 5B).

As seen from FIG. 4, a contour of the outer region 17 has a substantially right-angled triangle shape. Within the outer region 17, cavity rows are formed extending in the arrangement direction A. The cavity rows include three kinds of cavities, that is, cavities 16*a*, cavities 16*c*, and cavities 16*d*. The cavity rows are arranged in such a manner that the number of cavities decreases as the cavity rows gets closer from the longer side to the shorter side of the actuator unit 21.

Without discrimination between the pressure chambers 10 and the cavities included in the peripheral cavity group 15 or 16, recesses are regularly formed in the same pattern in a region of the upper face 4*a* of the passage unit 4 opposed to any pressure chamber 21. This can reduce load of design of the passage unit 4.

Moreover, since the peripheral cavity groups 15 and 16 are formed around the pressure chamber groups 9*a* and 9*b*, recesses surrounding an outermost one of the pressure chambers 10 of the pressure chamber groups 9*a* and 9*b* form the same pattern as that of recesses surrounding a pressure chamber 10 disposed on an inner side of the outermost ones. That is, in the pressure chamber groups 9*a* and 9*b*, many pressure chambers 10 are arranged into pressure chamber rows extending in the arrangement direction A or the arrangement direction B. In each of the pressure chamber rows, positions of neighboring pressure chambers 10 are shifted from each other at a predetermined interval in the arrangement direction A or the arrangement direction B. The peripheral cavity 15*a*, 15*b*, 16*a*, 16*b*, 16*c*, or 16*d* included in the peripheral cavity group 15 or 16 are formed at a position shifted in the arrangement direction A or the arrangement direction B at the same predetermined interval outward from the pressure chamber 10 that is located outermost in each of the pressure chamber rows with respect to the arrangement direction A or the arrangement direction B. Here, among the cavities 16*c*, only the cavities 16*c* disposed adjacent to a boundary between the active region 19*b* and the outer region 17 are formed at such positions. This relation is established not only between the pressure chamber 10 and the cavity 15*a*, 15*b*, 16*a*, 16*b*, 16*c*, or 16*d*, but also between the individual ink passage and the closed passage which are partially made up of the pressure chamber 10 and the cavity, respectively. Thus, the closed passage that includes the cavity 15*a*, 15*b*, 16*a*, 16*b*, 16*c*, or 16*d* constituting the peripheral cavity group 15 or 16 is formed at a position shifted in the arrangement direction A or the arrangement direction B at the same predetermined interval outward from the individual ink passage 7 that is located outermost in each of individual ink passage rows with respect to the arrangement direction A or the arrangement direction B.

As shown in FIG. 4, a nozzle group (ejection port group) 18 is formed in a region of the ink ejection face 70*a* of the passage unit 4 overlapping each actuator unit 21. In the nozzle group 18, ink ejection ports 8*a* and openings 108*a* provided in relation to closed passages 14 (see FIG. 5B) are arranged in a matrix. In a plan view, a contour of the nozzle group 18 is a trapezoidal shape slightly smaller than the actuator unit 21. In a plan view, as described above, the ink ejection ports 8*a* are formed at positions neighboring to the respective pressure chambers 10 and cavities 16*c* and not overlapping the sub manifold channels 5*a*.

Each of the imaginary planes K1 and K2 passes through a boundary between where a length of a region defining the nozzle group 18 and a length of the actuator unit 21 intercepted by the imaginary plane K1 or K2 are constant regardless of a position of the imaginary plane K1 or K2 and where the lengths vary as the imaginary plane K1 or K2 is displaced in the longitudinal direction. That is, each of the imaginary planes K1 and K2 passes through an outer obtuse-angle vertex of the nozzle group 18 and an outer obtuse-angle vertex of the actuator unit 21. As seen from FIG. 4, each of the imaginary planes K1 and K2 sections some of the pressure chambers 10 and cavities 16*c* disposed near the boundary between the active region 19*b* and the outer region 17.

Figure 5A:
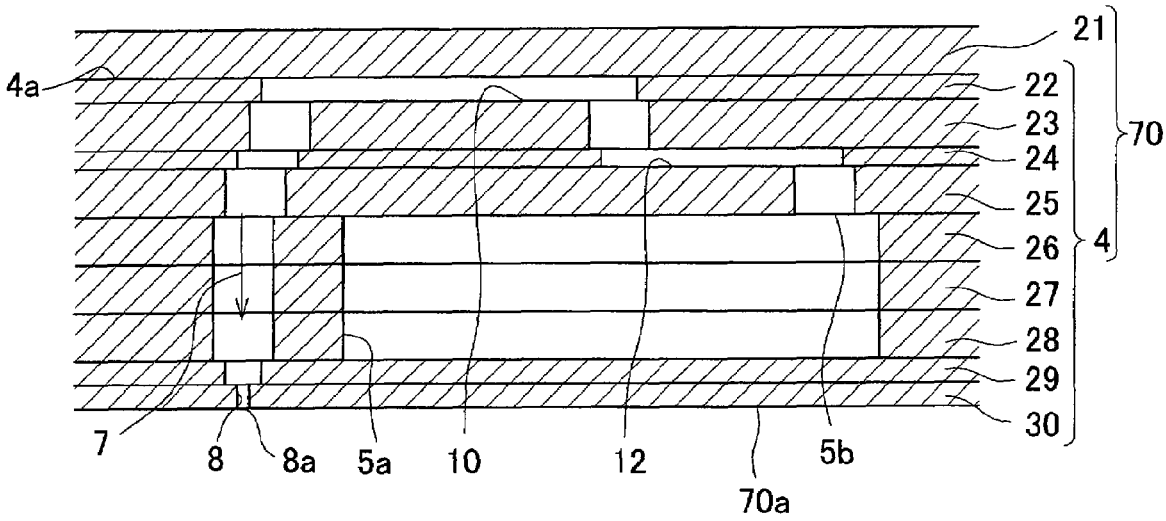
FIG. 5A is a sectional view taken along line VA-VA shown in FIG. 4.
Figure 5B:
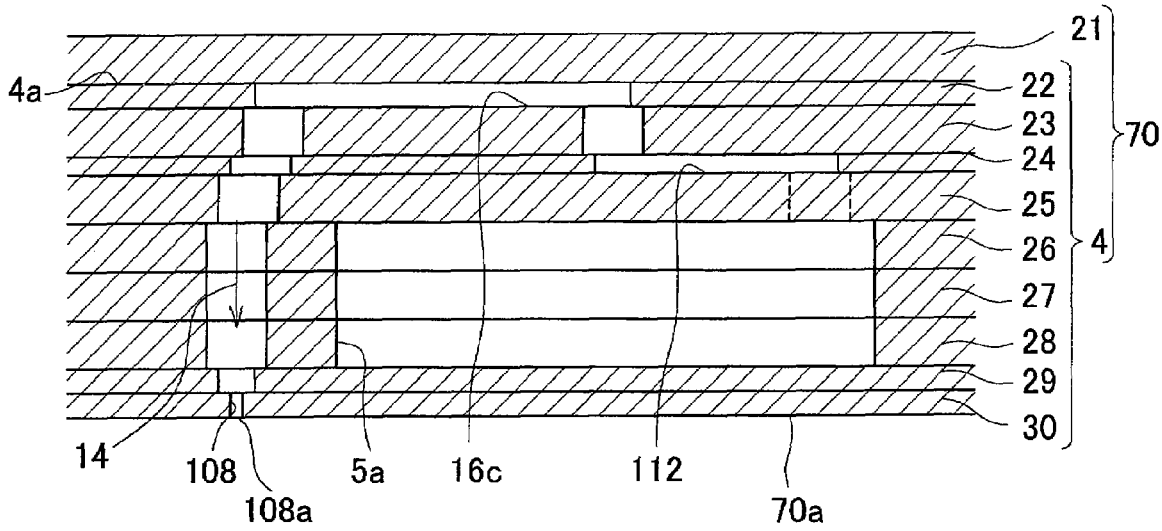
FIG. 5B is a sectional view taken along line VB-VB shown in FIG. 4.

Next, a cross section structure of the head main body 70 will be described. FIG. 5A is a sectional view taken along line VA-VA shown in FIG. 4. FIG. 5B is a sectional view taken along line VB-VB shown in FIG. 4. FIG. 5A shows an individual ink passage 7, and FIG. 5B shows a closed passage 14 including a cavity 16*c*. The individual ink passage 7 is provided corresponding to each pressure chamber 10 in the active regions 19*a* and 19*b*. The closed passage 14 is provided corresponding to each cavity 16*c* in the outer region 17. As shown in FIG. 5A, the individual ink passage 7 extends from an outlet 5*b* of a sub manifold channel 5*a* through an aperture 12 and a pressure chamber 10 to an ink ejection port 8*a*. As shown in FIG. 5B, the closed passage 14 including the cavity 16*c* has substantially the same shape as that of the individual ink passage 7 except that it is partially closed. The closed passage 14 does not communicate with a sub manifold channel 5*a*, as will be detailed later.

As shown in FIGS. 5A and 5B, the head main body 70 has a layered structure of ten sheet materials in total, namely, from the top, the actuator unit 21, a cavity plate 22, a base plate 23, an aperture plate 24, a supply plate 25, three manifold plates 26, 27, 28, a cover plate 29, and a nozzle plate 30, among which nine plates other than the actuator unit 21 constitute the passage unit 4.

A construction of the passage unit 4 will be described. The cavity plate 22 is a metal plate in which many substantially rhombic holes constituting pressure chambers 10 and many holes constituting the cavities 15*a*, 15*b*, 16*a* to 16*d* are formed in regions where the actuator units are bonded. The base plate 23 is a metal plate in which formed are connection holes each connecting each pressure chamber 10 of the cavity plate 22 to a corresponding aperture 12 and connection holes each connecting each pressure chamber 10 to a corresponding nozzle 8. Also formed in the base plate 23 are connection holes each connecting each cavity 16*c* to a corresponding dummy aperture 112 and connection holes each connecting each cavity 16*c* to a corresponding dummy nozzle 108 having an opening 108*a*.

The aperture plate 24 is a metal plate in which formed are holes serving as apertures 12 and connection holes each connecting each pressure chamber 10 to a corresponding nozzle 8. Also formed in the aperture plate 24 are holes serving as dummy apertures 112 and connection holes each connecting a cavity 16*c* to a corresponding dummy nozzle 108. The supply plate 25 is a metal plate in which formed are connection holes each connecting each aperture 12 to a sub manifold channel 5*a* (which means holes that constitute outlets 5*b*) and connection holes each connecting each pressure chamber 10 to a corresponding nozzle 8. Also formed in the supply plate 25 are connection holes each connecting each cavity 16*c* to a corresponding dummy nozzle 108. Each of the three manifold plates 26, 27, and 28 is a metal plate in which formed are holes constituting sub-manifold channels 5*a* and connection holes each connecting each pressure chamber 10 to a corresponding nozzle 8. Also formed in each of the three manifold plates 26, 27, and 28 are connection holes each connecting each cavity 16*c* to a corresponding dummy nozzle 108. The cover plate 29 is a metal plate in which formed are connection holes each connecting each pressure chamber 10 to a corresponding nozzle 8. Also formed in the cover plate 29 are connection holes each connecting each cavity 16*c* to a corresponding dummy nozzle 108. The nozzle plate 30 is a metal plate in which formed are nozzles 8 for the respective pressure chambers 10 and dummy nozzles 108 for the respective cavities 16*c*.

The nine metal plates 22 to 30 are positioned in layers so as to form the individual ink passages 7 and the closed passages 14. The individual ink passage 7 firstly extends upward from the sub-manifold channel 5*a*, then extends horizontally in the aperture 12, then further extends upward, then again extends horizontally in the pressure chamber 10, then extends obliquely downward in a certain length away from the aperture 12, and then extends vertically downward toward the nozzle 8. A connection hole that connects the dummy aperture 112 to the sub manifold channel 5*a* (as illustrated with broken lines in FIG. 5B) is not formed. More specifically, the dummy aperture 112 and an outlet of the sub manifold channel 5*a* are not connected but a portion between them is closed. Therefore, the closed passage 14 is an isolated passage supplied with no ink and extending from the dummy aperture 112 through the cavity 16*c* to the dummy nozzle 108. All the closed passages 14 do not communicate with the sub manifold channel 5*a*.

Figure 5C:
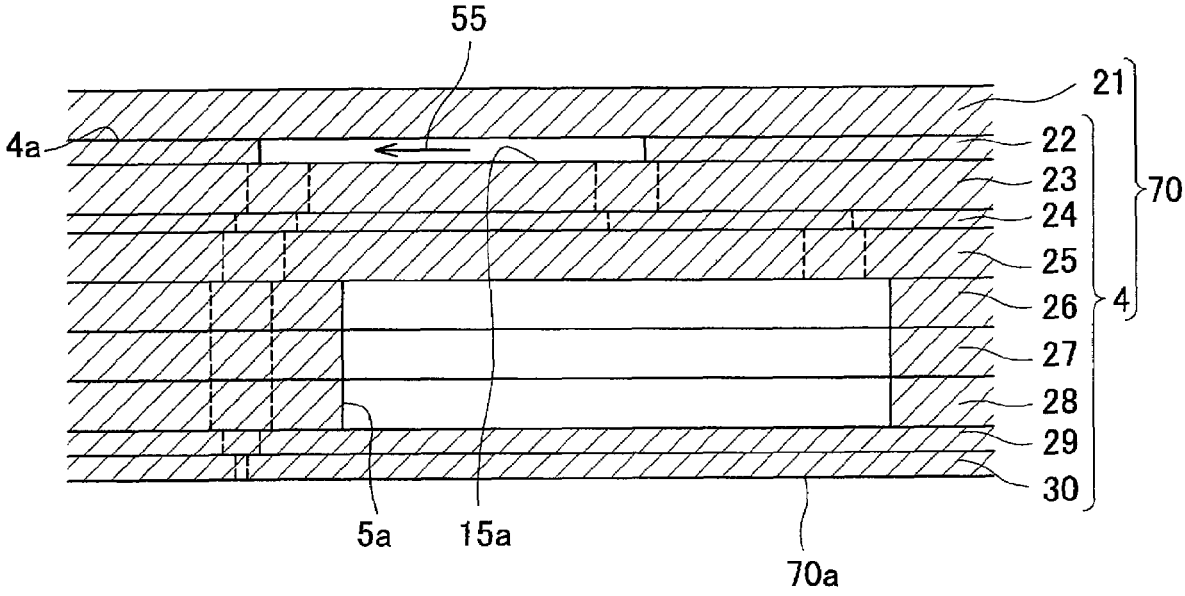
FIG. 5C is a sectional view taken along line VC-VC shown in FIG. 4.

Holes communicating with cavities 15*a*, 15*b*, 16*a*, 16*b*, and 16*d* other than 16*c* are not formed in the base plate 23. FIG. 5C shows a sectional view of the closed passage 55 including the cavity 15*a*. The closed passage 55 including the cavity 15*a* is in the shape of the individual ink passage being entirely closed except the cavity 15*a*. Each of the closed passages including the other cavities 15*b*, 16*a*, 16*b*, and 16*d* has the same cross section as that of the closed passage 55 shown in FIG. 5C. In the following, the term "closed passage 55" means not only a closed passage corresponding to the cavity 15*a*, but sometimes also a closed passage corresponding to the cavity 15*b*, 16*a*, 16*b*, or 16*d*.

Figure 6A:
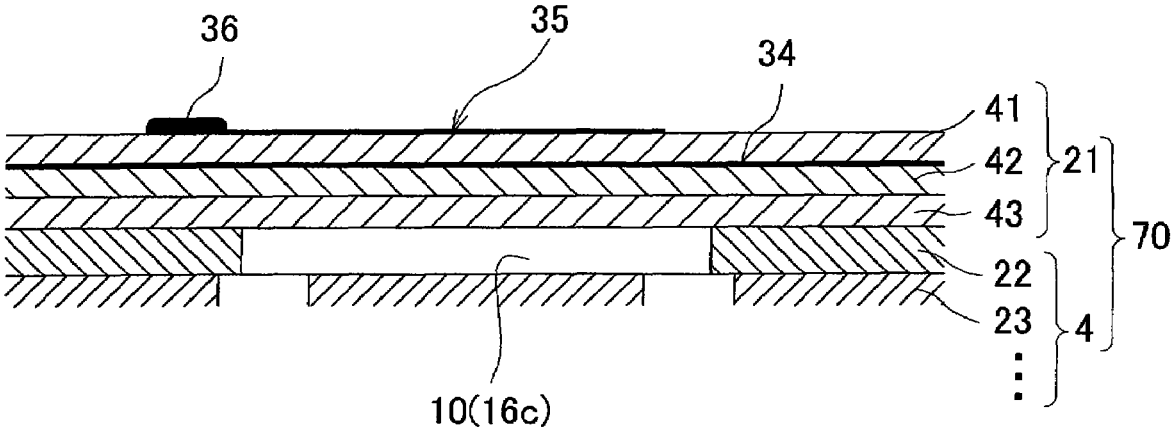
FIG. 6A is a sectional view showing on an enlarged scale a part around a boundary between an actuator unit and a passage unit.

Next, a construction of the actuator unit 21 will be described with reference to FIGS. 6 and 7. FIG. 6A is a sectional view showing on an enlarged scale a part around a boundary between the actuator unit 21 and the passage unit 4. A construction shown in FIG. 6A is common to a cross section including the pressure chamber 10 and a cross section including the cavity 16*c*. The actuator unit 21 has a layered body in which three piezoelectric sheets 41 to 43 are put in layers. Each of the three piezoelectric sheets 41 to 43 has a thickness of 15 μm. Each of the piezoelectric sheets 41 to 43 is configured as a continuous layer-like flat plate (continuous flat layer) extending over many pressure chambers 10 included in the pressure chamber groups 9*a*, 9*b* and cavities 15*a*, 15*b*, 16*a* to 16*d* included in the peripheral cavity groups 15, 16. The piezoelectric sheets 41 to 43 are made of a lead zirconate titanate (PZT)-base ceramic material having ferroelectricity.

Individual electrodes 35 each having a thickness of approximately 1 μm are formed on the uppermost piezoelectric sheet 41. The individual electrodes 35 are opposed to the respective pressure chambers 10 and cavities 16*c*. A common electrode 34 having a thickness of approximately 2 μm is interposed between the piezoelectric sheet 41 and the piezoelectric sheet 42 disposed under the piezoelectric sheet 41. In a plan view, the common electrode 34 has the same shape as that of the piezoelectric sheet 41. No electrode is disposed between the piezoelectric sheets 42 and 43. Consequently, only the uppermost piezoelectric sheet 41 is an active layer including a portion that works as an active portion when an electric field is applied thereto. The piezoelectric sheets 42 and 43 are inactive layers including no active portion. Both the individual electrodes 35 and the common electrode 34 are made of, e.g., an Ag—Pd-base metallic material.

Figure 6B:
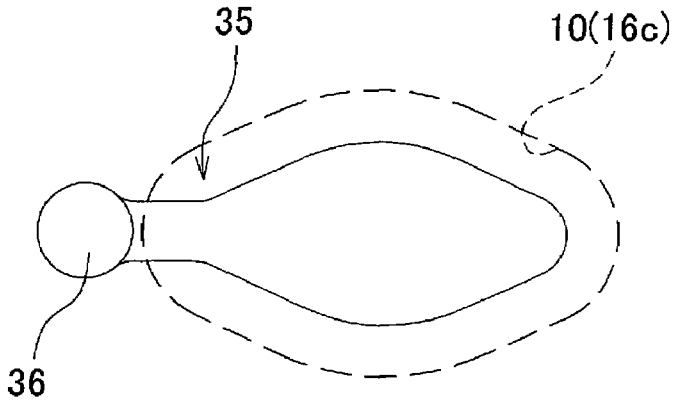
FIG. 6B is a partial plan view showing on an enlarged scale a shape of an individual electrode formed on a surface of the actuator unit.

FIG. 6B is a partial plan view showing on an enlarged scale a shape of the individual electrode formed on a surface of the actuator unit 21. As shown in FIG. 6B, in a plan view, a shape of the individual electrode 35 is substantially rhombic and substantially similar to that of the pressure chamber 10 or the cavity 16*c*. In a plan view, a large part of the individual electrode 35 falls within the pressure chamber 10 or the cavity 16*c*. The substantially rhombic individual electrode 35 has its one acute portion extending out, and a circular land 36 having an approximately 160 μm is provided on an end of an extending-out portion thus formed. The land 36 is electrically bonded to the individual electrode 35. The land 36 is a conductive member made of gold including glass frits. As shown in FIG. 6A, the land 36 is not opposed to the pressure chamber 10 or the cavity 16*c*.

Figure 7:
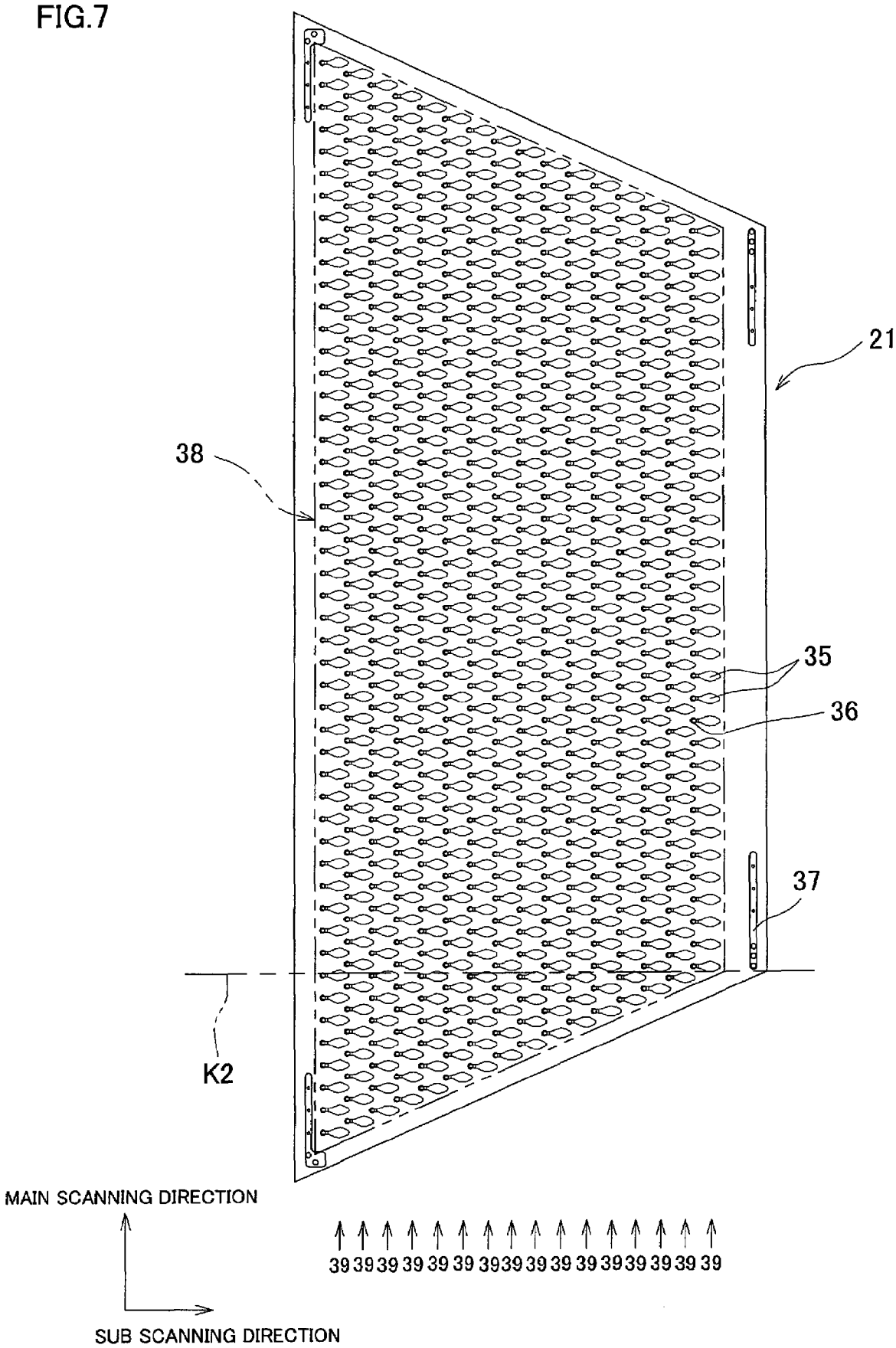
FIG. 7 is a plan view of the actuator unit.

FIG. 7 is a plan view of the actuator unit 21 having the imaginary plane K2 passing therethrough. This actuator unit 21 has the same structure as those of the other three actuator units 21. As shown in FIG. 7, the individual electrodes 35 formed on the actuator unit 21 are arranged in the same pattern as that of the pressure chambers 10 and the cavities 16*c*. The individual electrodes 35 form an individual electrode group 38. Since individual electrode groups 38 are formed on the other three actuator units 21 as well, there are four individual electrode groups 38 on the head main body 70.

The individual electrode group 38 is made up of individual electrode rows 39. Each of the individual electrode rows 39 includes individual electrodes 35 formed along the main scanning direction. The number of individual electrodes 35 included in each individual electrode row 39 decreases as the individual electrode row 39 gets closer from the longer side to the shorter side of the actuator unit 21. Consequently, a contour of the individual electrode group 38 is a trapezoidal shape substantially similar to the contour of the actuator unit 21. The imaginary plane K1, K2 passes through a boundary between where a length of a region defining the individual electrode group 38 intercepted by the imaginary plane K1, K2 is constant regardless of a position of the imaginary plane K1, K2 and where the length varies as the imaginary plane K1, K2 is displaced in the longitudinal direction. That is, the imaginary plane K1, K2 passes through an outer obtuse-angle vertex of the individual electrode group 38.

Common electrode terminals 37 are provided near four corners of an upper face of the actuator unit 21. The common electrode terminals 37 are electrically connected to the common electrode 34 via through-hole electrodes that penetrate the piezoelectric sheet 41. The common electrode 34 is grounded through the common electrode terminals 37 and the FPC 50. Consequently, the common electrode 34 is, in its portions corresponding to all the pressure chambers 10, equally kept at the ground potential. The individual electrodes 35 are, through the lands 36 and the FPC 50, electrically connected to respective terminals of the driver IC 80. A drive signal supplied from the driver IC 80 is thus supplied to the individual electrode 38.

Next, how the actuator unit 21 drives will be described. The piezoelectric sheet 41 of the actuator unit 21 is polarized in its thickness direction. That is, the actuator unit 21 has a so-called unimorph-type structure in which the piezoelectric sheet 41 is an active layer while the piezoelectric sheets 42 to 43 existing between the active layer and the pressure chambers 10 are inactive layers. Accordingly, when an individual electrode 35 is set at a positive or negative predetermined potential and a direction of an electric field is the same as a polarization direction for example, a portion of the piezoelectric sheet 41 sandwiched between electrodes and applied with the electric field acts as an active portion, i.e., a pressure generating portion, and deforms in a direction perpendicular to the polarization direction.

The piezoelectric sheets 42 and 43 are not affected by the electric field and do not deform by themselves. As a result, difference in distortion in a direction perpendicular to the polarization direction occurs between the upper piezoelectric sheet 41 and the lower piezoelectric sheets 42, 43, so that the piezoelectric sheets 41 to 43 as a whole deform protrudingly toward a pressure chamber 10 (unimorph deformation). At this time, as shown in FIG. 6A, a lower face of the actuator unit 21 is fixed to an upper face of a wall (cavity plate 22) that partitions the pressure chambers. Consequently, a portion corresponding to the individual electrode 35 deforms protrudingly toward the pressure chamber 10. This reduces the volume of the pressure chamber 10 thus raising ink pressure, so that ink is ejected from a nozzle 8. Then, when resetting the individual electrode 35 at the same potential as that of the common electrode 34, the piezoelectric layers 41 to 43 restore their original shapes and the pressure chamber 10 restores its original volume. Ink is accordingly sucked from a sub manifold channel 5*a*.

In another possible driving mode, an individual electrode 35 is in advance set at a potential different from that of the common electrode 34. Upon every ejection request, the individual electrode 35 is once set at the same potential as that of the common electrode 34, and then at a predetermined timing the individual electrode 35 is again set at a potential different from that of the common electrode 34. In this mode, at a timing of setting the individual electrode 35 at the same potential as that of the common electrode 34, the piezoelectric sheets 41 to 43 restore their original shapes and thus the volume of a pressure chamber 10 becomes larger than in an initial state where the potential of individual electrode 35 is different from the potential of the common electrodes 34. Ink is accordingly sucked from a sub manifold channel 5*a* into the pressure chamber 10. Then, at a timing of setting the individual electrode 35 at the potential different from that of the common electrode 34, the piezoelectric sheets 41 to 43 deform protrudingly toward the pressure chamber 10. This reduces the volume of the pressure chamber 10 thus raising ink pressure, so that ink is ejected from a nozzle 8. The individual electrodes 35 are formed also in a region of the actuator unit 21 opposed to the cavities 16*c*. However, even when an individual electrode 35 corresponding to a cavity 16*c* is driven, no ink is ejected, because the cavity 16*c* is an isolated passage not communicating with a sub manifold channel 5*a*. Therefore, a drive signal may either be or not be supplied to the individual electrode 35 that is formed corresponding to the cavity 16*c*.

Figure 8:
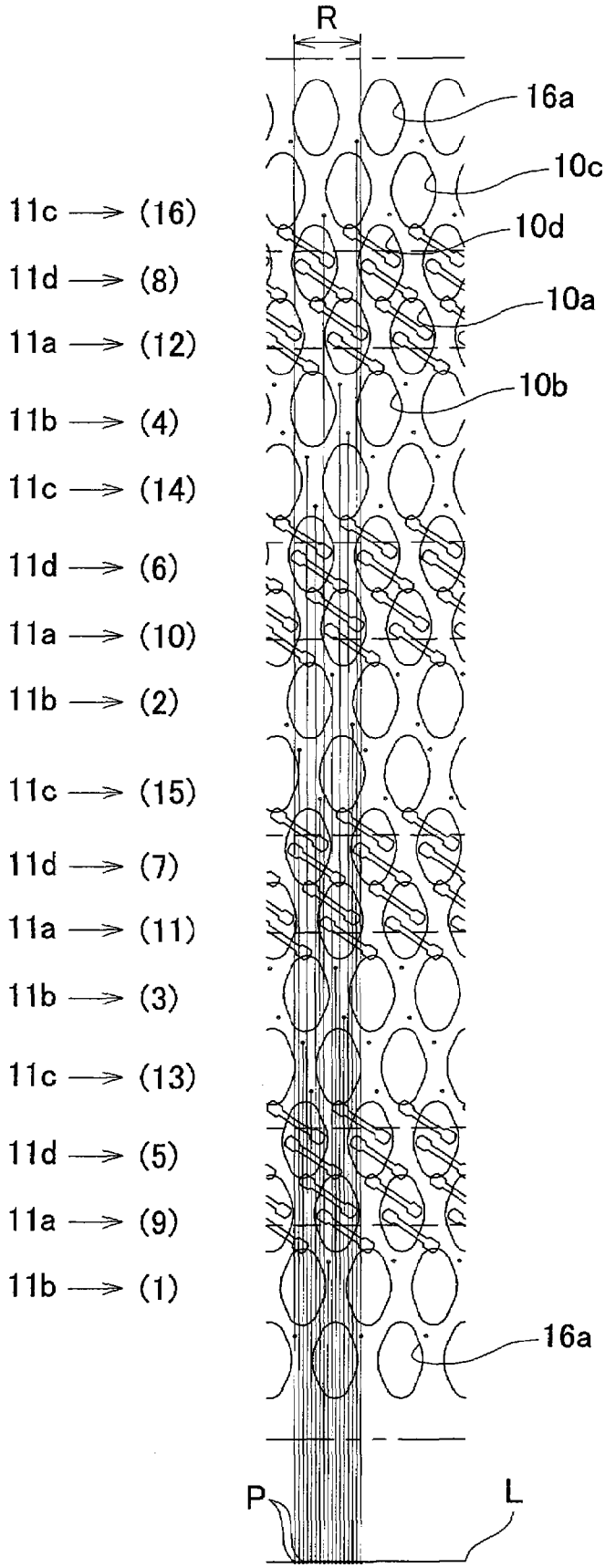
FIG. 8 shows on an enlarged scale a region enclosed with an alternate long and short dash line in FIG. 4.

FIG. 8 shows on an enlarged scale a region enclosed with an alternate long and short dash line in FIG. 4. Here, a band region R shown in FIG. 8 will be discussed. The band region R has a width corresponding to 37.5 dpi, that is, a width of 678.0 μm, along the arrangement direction A. The band region R is elongated in a direction perpendicular to the arrangement direction A. Within the band region R, any of the sixteen pressure chamber rows 11*a* to 11*d* includes only one ink ejection port 8*a*. Wherever in the active region 19*a* or 19*b* the band region R is set, there are always a total of sixteen nozzles 8, each included in each of the sixteen pressure chamber rows 11*a* to 11*d*, within the band region R. When the sixteen ink ejection ports 8*a* are projected in a direction perpendicular to an imaginary line L that extends in the arrangement direction A, their projective points P onto the imaginary line L are spaced apart from each other at intervals corresponding to 600 dpi which is a printing resolution. In other words, when all the ink ejection ports 8*a* are projected onto the imaginary line L, their projective points P align on the imaginary line L at regular intervals, and the imaginary planes K1 and K2 that define the active regions 19*a* and 19*b* pass through ones of the projective points P existing at both ends.

Assuming that sixteen nozzles 8 included in one band region R are denoted by (1) to (16) sequentially from the one whose projective point is located at the most left on the imaginary line L, these sixteen nozzles 8 are arranged in an order of, from a lower side, (1), (9), (5), (3), (13), (11), (7), (2), (15), (10), (6), (4), (14), (12), (8), and (16). Assuming that sixteen pressure chambers 10 corresponding to sixteen nozzles 8 included in one band region R are denoted by (1) to (16) sequentially from the one located at the most left with respect to a direction along the imaginary line L, these sixteen pressure chambers 10 are arranged in an order of, from a lower side, (1), (9), (5), (13), (3), (11), (7), (15), (2), (10), (6), (14), (4), (12), (8), and (16). Like this, when making a comparison between arrangement of the ink ejection ports 8*a* and arrangement of the pressure chambers 10 within the band region R, they are replaced in fourth and fifth rows, in eighth and ninth rows, and in twelfth and thirteenth rows, respectively. This is because the pressure chambers 10 are arranged at a high density and in addition the ink ejection ports 8*a* are maldistributed.

In the above-described ink-jet head 1, characters, figures, and the like can be formed at a resolution of 600 dpi, by properly driving the actuator unit 21 in accordance with conveyance of a paper. For example, in order to print a straight line extending in the arrangement direction A at a resolution of 600 dpi, ink is ejected in synchronization with conveyance of a paper from nozzles 8 in an order of (1), (9), (5), (3), (13), (11), (7), (2), (15), (10), (6), (4), (14), (12), (8), and (16) in a case where the paper is conveyed from down to top in FIG. 8.

Since each end portion of each nozzle group 18 with respect to the arrangement direction A makes a complementarity relation with an end portion of another neighboring nozzle group 18, a printing resolution of 600 dpi can be realized over a range covering the four nozzle groups 18.

As thus have been described above, in the ink-jet head 1 of this embodiment, the closed passages 14 and 55 that do not communicate with the sub manifold channels 5*a* are formed in the passage unit 4. The closed passage 14, 55 is formed at a position shifted in the arrangement direction A or the arrangement direction B at the above-mentioned predetermined interval outward from the individual ink passage 7 that is located outermost in each of the individual ink passage rows with respect to the arrangement direction A or the arrangement direction B. Here, among the closed passages 14 corresponding to the cavities 16*c*, only the closed passages 14 disposed adjacent to the boundary between the active region 19*b* and the outer region 17 are formed at such positions. This can reduce variation in rigidity among regions surrounding the respective individual ink passages 7 in the active regions 19*a* and 19*b*. Consequently, any individual ink passage 7 exhibits substantially the same ink ejection performance. Thus, the peripheral cavity groups 15 and 16 contribute to ink ejection in a sense of reducing variation in ink ejection performance depending on a location within the pressure chamber groups 9*a* and 9*b*. A degree of this effect is affected by a size and a location of a cavity left in the closed passage 14, 55. However, as long as the closed passage 14, 55 is formed in the passage unit 4, the above-described effect can be obtained though its degree may vary.

The cavities 15*a*, 15*b*, 16*a*, 16*b*, 16*c*, and 16*d*, which are equivalent to the pressure chambers 10 in height level, greatly affect ink ejection performance of the active regions 19*a* and 19*b*, in terms of rigidity of regions surrounding the respective individual ink passages 7 including these pressure chambers 10. Therefore, when like in this embodiment the closed passages 14 and 15 have cavities formed at the same level as the pressure chambers 10 are, variation in rigidity among regions surrounding the respective individual ink passages 7 is greatly reduced, so that variation depending on locations of the individual ink passages is greatly reduced.

Among the cavities 16*c* existing in the outer region 17, some cavities 16*c* disposed adjacent to the boundary between the active region 19*b* and the outer region 17 most largely contribute to ink ejection in the sense of reducing variation in ink ejection performance depending on a location within the pressure chamber group 9*b*. In addition, the other cavities 16*c* existing in the outer region 17 also serve to reduce variation in ink ejection performance depending on a location within the pressure chamber group 9*b*, though a degree of the service is smaller than that of the some cavities 16*c* disposed adjacent to the boundary.

Moreover, since no ink is supplied to the closed passages 14 and 55, no ink is ejected from closed passages 14 and 55 even when the head performs a purge operation. Ink is accordingly not wastefully consumed. In addition, even when air bubbles enter a closed passage 14 through an opening 108*a* of the closed passage 14, the air bubbles do not go from the closed passage 14 into the sub manifold channel 5*a* because all the closed passages 14 do not communicate with the sub manifold channels 5*a*.

In the ink-jet head 1 of this embodiment, the four actuator units 21 are given the same structure in view of production efficiency. Therefore, the individual electrodes 35 are distributed substantially over a whole area of the actuator unit 21. However, some of the individual electrodes 35 formed in the outermost two actuator units, that is, individual electrodes 35 existing in the outer regions 17, are not used for a printing operation. This is because, since each of the actuator units 21 has a trapezoidal shape, the individual electrodes 35 existing in the outer region 17 cannot establish a complementarity relation with individual electrodes 35 formed on another neighboring actuator unit 21 and therefore cannot print an image at a predetermined resolution. Further, in order to reduce load of design, the FPC 50 which is a wire member that gives a drive signal to the individual electrode 35 of the actuator unit 21, and a drive signal that is given for the head 1 to perform a purge operation are common to all the actuator units 21. Therefore, if, instead of the closed passage 14, a passage like the individual ink passage 7 communicating from a sub manifold channel 5*b* to an ejection port is formed in the outer region 17, ink is wastefully consumed and besides air bubbles may enter the sub manifold channel 5*a*. In this embodiment, however, the closed passages 14 each having the same shape as that of the individual ink passage 7 are formed in the passage unit 4 in the same pattern as an arrangement pattern of the individual ink passages 7. As a result, the advantageous effects as mentioned above can be obtained while reducing load of design as much as possible.

Connection holes connecting the closed passages 14 and 55 to the sub manifold channels 5*a* are not formed in the supply plate 25. Therefore, when ink is initially introduced into the sub manifold channels 5*a*, the closed passages 14 and 55 are not filled with the ink. The ink can be saved accordingly. Moreover, at the initial introduction, no air bubbles stay around such connection holes. If air bubbles stay around the connection holes, the air bubbles may return to the sub manifold channel 5*a* and enter the individual ink passages 7 that are connected to the sub manifold channel 5*a*. This may cause ink ejection failure. Even without such reverse flow of air bubbles, components of the air may blend into ink to cause abnormal ink ejection performance. In this embodiment, however, good ink ejection is not hindered because no air bubbles stay around the connection holes.

Since the four actuator units 21 have the same shape, manufacturing of the actuator unit 21 is easier. In addition, since the four actuator units 21 are arranged in two rows in a zigzag pattern along the main scanning direction, it is easier to fix the four actuator units 21 to the passage unit 4. Moreover, since the number of actuator units 21 is equal to or more than three (four in this embodiment), a large-length head suitable for a line printer can be realized. Further, since the actuator unit 21 has a trapezoidal shape with two acute angles, it is easier to design the actuator unit 21.

The imaginary plane K1, K2, that is, a boundary between the active region 19*b* and the outer region 17, passes through a boundary between where lengths of the region defining the nozzle group 18, the region defining the individual electrode group 38, and the actuator unit 21 intercepted by the imaginary plane K1, K2 are constant regardless of a position of the imaginary plane K1, K2 and where the lengths vary as the imaginary plane K1, K2 is displaced in the longitudinal direction. Therefore, the boundary between the active region 19*b* and the outer region 17 can clearly be seen from its external appearance. Thus, in assembling the ink-jet head 1 to a printer, a paper which will be conveyed and the active regions 19*a*, 19*b* can be positioned to each other with high accuracy.

FIG. 5B illustrates, as an example, that a closed passage is closed between a counterpart to an outlet of a common ink chamber in an individual ink passage and a counterpart to an inlet of a pressure chamber in the individual ink passage. Another example of the same case is illustrated in FIG. 5C. In still other examples, the connection holes each connecting each cavity 16*c* to a corresponding dummy aperture 112 are not formed in the base plate 23, and the holes serving as dummy apertures 112 are not formed in the aperture plate 24.

The cavity plate 22 has the cavities 16*c* formed within the outer region 17 and adjacently to the active region 19*b*. Therefore, recesses surrounding an outermost one of the pressure chambers 10 of the pressure chamber group 9*b* which is adjacent to the outer region 17 form the same pattern as that of recesses surrounding a pressure chamber 10 disposed on an inner side of the outermost ones. As a result, variation in rigidity among regions surrounding the respective individual ink passages 7 within the pressure chamber group 9*b* is reduced, so that variation in ink ejection performance of the individual ink passages depending on their locations can be reduced.

Further, many closed passages 14, 55 are arranged over an entire circumference of the active region 19*a*, 19*b*. Consequently, rigidity of a region surrounding every individual ink passage 7 disposed outermost in the active region 19*a*, 19*b* can get close to rigidity of a region surrounding each of the other individual ink passages 7. As a result, variation in ink ejection performance depending on a location can further be reduced.

Figure 9:
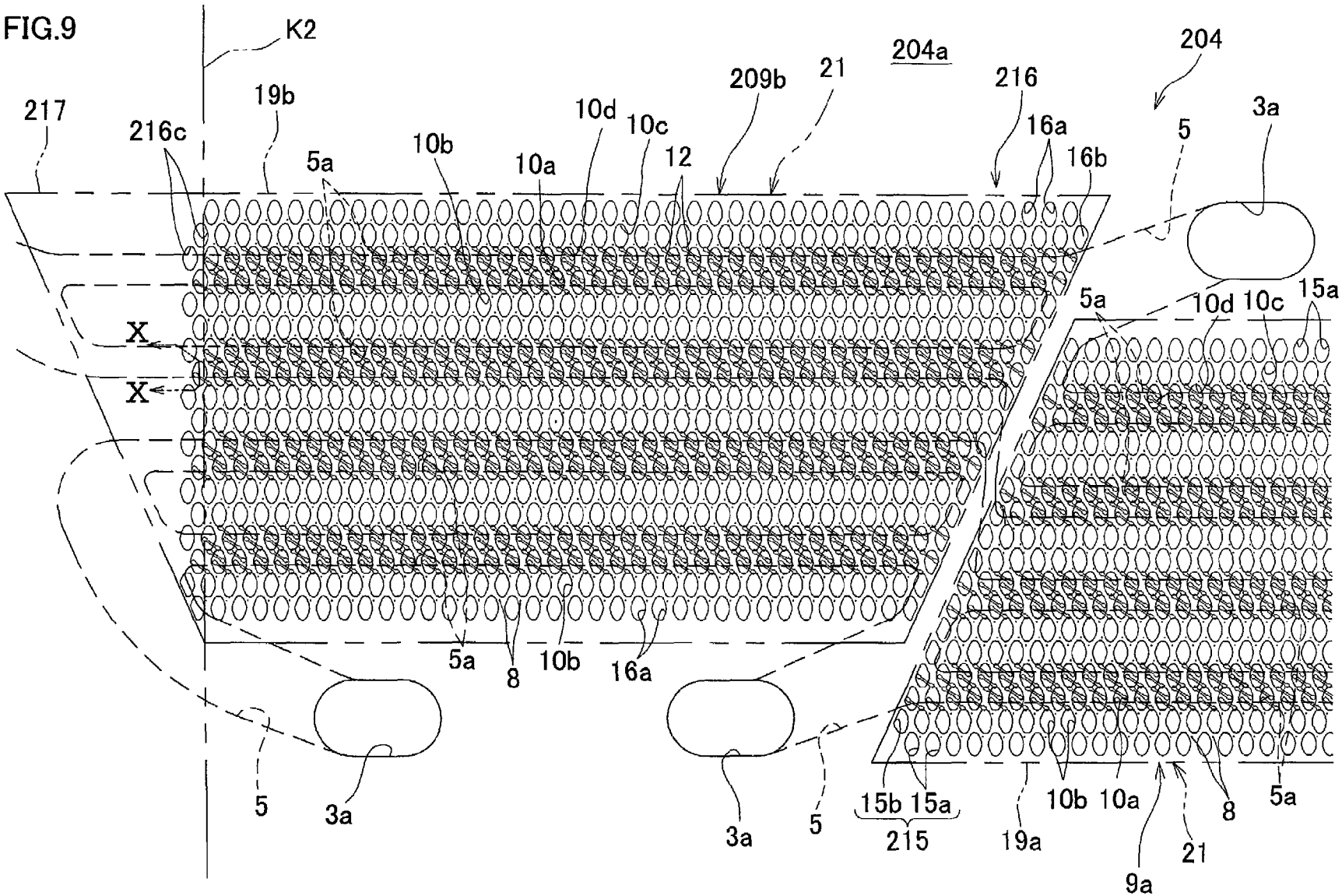
FIG. 9 is a partial plan view showing on an enlarged scale a head main body of an ink-jet head according to a second embodiment of the present invention.
Figure 10:
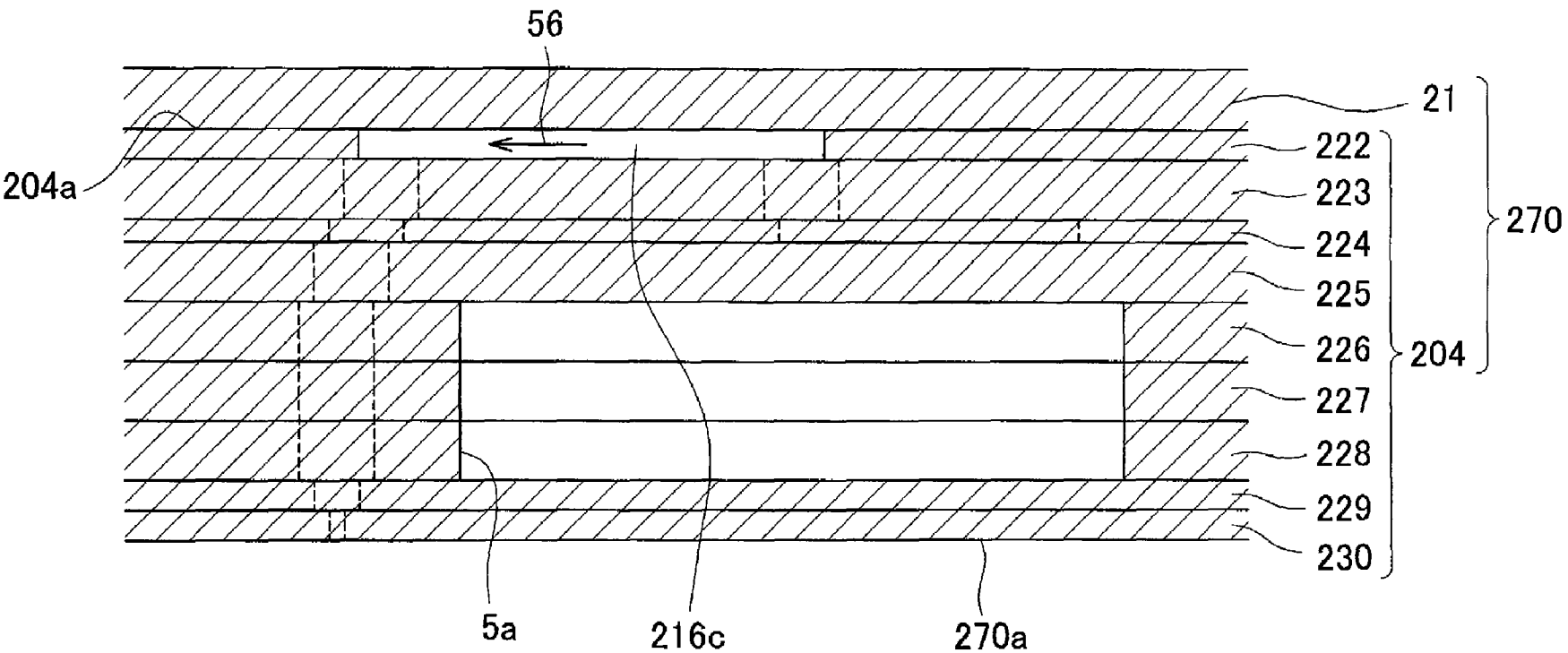
FIG. 10 is a sectional view taken along line X-X shown in FIG. 9.

Next, an ink-jet head according to a second embodiment of the present invention will be described. FIG. 9 is a partial plan view showing on an enlarged scale a head main body of an ink-jet head according to a second embodiment of the present invention. FIG. 10 is a sectional view taken along line X-X shown in FIG. 9. The same members as in the first embodiment will be denoted by the same reference numerals, without a specific description thereof.

An ink-jet head of this embodiment is similar to that of the first embodiment except that a passage unit 204 of a head main body 270 is a little different from the passage unit 4 of the first embodiment. On an upper face 204*a* of the passage unit 204, as shown in FIG. 9, pressure chamber groups 9*a* and 209*b* are formed in regions opposed to respective actuator units 21. Peripheral cavity groups 215 and 216 are also formed so as to enclose the pressure chamber groups 9*a* and 209*b*, respectively. The peripheral cavity group 215 is the same as the peripheral cavity group 15 of the first embodiment. The pressure chamber group 209*b* is formed substantially in the same manner as the pressure chamber group 9*b* is. In the pressure chamber group 209*b*, pressure chambers 10 arranged in a matrix form an active region 19*b*.

The peripheral cavity group 216 includes cavities 16*a*, 16*b*, and 216*c*. Each one of the cavities 216*c* is disposed on an outer side of each pressure chamber row 11 that constitutes the active region 19*b*. Thus, the peripheral cavity group 216 is the same as the peripheral cavity group 16 of the first embodiment except that it includes no cavities 16*d* and a reduced number of cavities 16*c*. With such peripheral cavity groups 215 and 216, recesses surrounding an outermost one of the pressure chambers 10 of the pressure chamber group 9*a*, 209*b* form the same pattern as that of recesses surrounding a pressure chamber 10 disposed on an inner side of the outermost ones. Therefore, the same effect as in the first embodiment can be presented, in that any individual ink passage 7 exhibits substantially the same ink ejection performance because variation in rigidity among regions surrounding respective individual ink passages 7 including the pressure chambers 10 is reduced.

As shown in FIG. 10, the head main body 270 has a layered structure of the actuator unit 21 and nine plates 222 to 230, like in the first embodiment. Like each of the plates 22 to 30 of the first embodiment, each of the plates 222 to 230 that constitute the passage unit 204 has, within the active regions 19*a* and 19*b*, holes corresponding to individual ink passages 7.

Within an outer region 217 on the other hand, all formed in the plates 222 to 230 constituting the passage unit 204 are no more than holes serving as the cavities 216*c* and holes serving as sub manifold channels 5*a*. The holes serving as the cavities 216*c* are formed in the cavity plate 222 which is the uppermost one of the nine plates 222 to 230. The holes serving as sub manifold channels 5*a* are formed in the three sub manifold plates 226 to 228. That is, the eight plates 223 to 230 other than the cavity plate 222 have no holes for forming closed passages 56 that include the cavities 216*c* (as illustrated with broken lines in FIG. 10). As a result, formed in the outer region 217 of the passage unit 204 are the closed passages 56 made up only of the cavities 216*c* and communicating with neither outside nor the sub manifold channel 5*b*. Both openings of the cavity 216*c* constituting the closed passage 56 are closed by the base plate 223 and the actuator unit 21. Both openings of the other cavities 15*a*, 15*b*, 16*a*, and 16*b* are also closed by the base plate 223 and the actuator unit 21.

The above-described ink-jet head of the second embodiment presents the same advantageous effects as obtained by the ink-jet head 1 of the first embodiment, and also presents an advantageous effect that due to a reduced number of cavities 216*c*, the passage unit 204 is easier to manufacture than the passage unit 4 of the first embodiment. In addition, since no passage components but the cavities 216*c* and the sub manifold channels 5*a* are formed in the outer region 17, manufacturing of the passage unit 204 can be simplified all the more.

In particular, no through holes corresponding to the closed passages 56 are formed in the nozzle plate 230. Therefore, while a wiping operation is performed in which a wiper wipes off ink adhering to an ink ejection face 270*a*, ink does not enter the closed passages 56. Moreover, foreign materials adhering to the ink ejection face 70*a* do not enter the closed passages 56.

Figure 11:
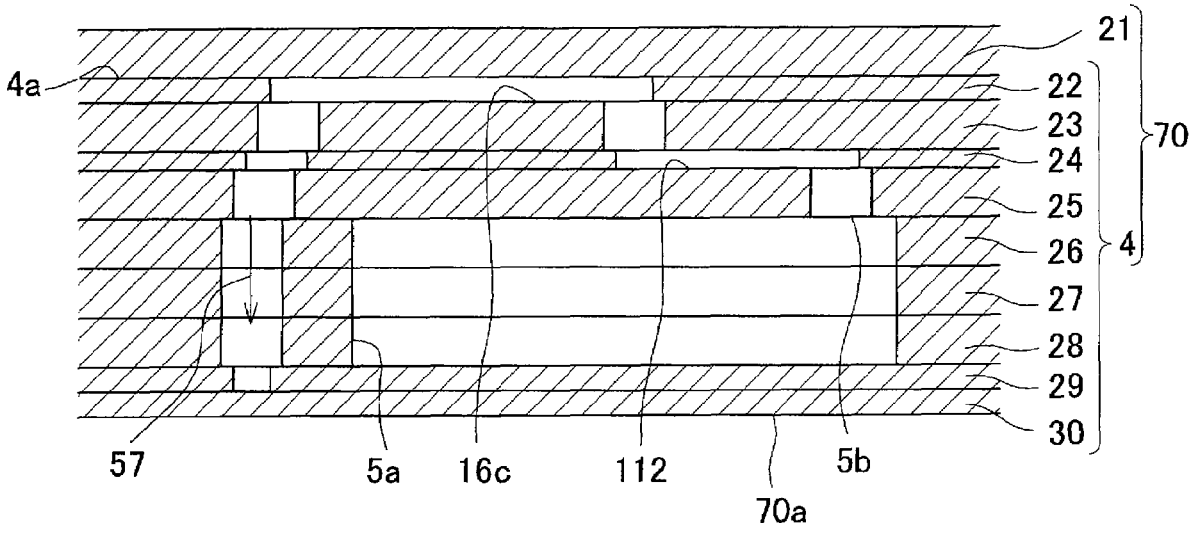
FIG. 11 is a sectional view, in correspondence to FIG. 5B, of an ink-jet head according to a third embodiment of the present invention.

Next, a third embodiment of the present invention will be described. FIG. 11 is a sectional view showing this embodiment in correspondence with FIG. 5B. A closed passage 57 shown in FIG. 11 differs from the closed passage 14 of the first embodiment only in that, with respect to each cavity 16*c*, a supply plate 25 has a connection hole connecting a dummy aperture 112 to a sub manifold channel 5*a* (which means a hole constituting an outlet 5*b*) and a nozzle plate 30 has no through hole. Closed passages corresponding to cavities 15*a*, 15*b*, 16*a*, 16*b*, and 16*d* other than 16*c* have the same cross-section structure as shown in FIG. 11.

An only difference between a structure of the closed passage 57 and a structure of the individual ink passage 7 is presence or absence of the through hole in the nozzle plate 30 which is very thin and therefore have little influence on rigidity of a passage unit 4. Consequently, variation in rigidity among regions surrounding the respective individual ink passages 7 is greatly reduced, so that variation in ink ejection performance depending on locations can be reduced more greatly than in the first and second embodiments. In addition, since the nozzle plate 30 has no through holes corresponding to the closed passages 57, ink and foreign materials do not enter the closed passages 57 even when a wiping operation is performed in which a wiper wipes off ink adhering to an ink ejection face 70*a*.

FIG. 11 illustrates, as an example, that a closed passage is closed between a counterpart to an outlet of a pressure chamber in an individual ink passage and a counterpart to an ink ejection port in the individual ink passage. Another example of the same case is illustrated in FIG. 5C. In still another example, the connection holes each connecting each cavity 16*c* to a corresponding dummy nozzle 108 (see FIG. 5B) are not formed in at least one of the plates 23 to 29.

In the present invention, the closed passage may be provided anywhere in the passage unit. In addition, it is not necessary that all passages other than the individual ink passages, such as passages provided outside the active region, are closed passages. It may also be possible that only one or some of the passages provided outside the active region are closed passages.

In the present invention, further, the closed passage may be closed in a counterpart to any portion of the individual ink passage.

It may not always be necessary that a boundary between the active region and the outer region passes through an obtuse-angle vertex of the actuator unit, an obtuse-angle vertex of the region defining the individual electrode group, an obtuse-angle vertex of the individual electrode group. It may be possible that a position of the obtuse-angle vertex of the actuator unit, a position of the obtuse-angle vertex of the region defining the individual electrode group, a position of the obtuse-angle vertex of the individual electrode group are shifted with respect to the longitudinal direction of the passage unit.

One or two actuator units may be fixed to the passage unit, or alternatively four or more actuator units may be fixed to the passage unit. The actuator unit may have any shape in a plan view.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head including:

a passage unit in which formed are a common ink chamber and a plurality of individual ink passages, each individual ink passage extending from an outlet of the common ink chamber through at least one of a plurality of pressure chambers to one of a plurality of ink ejection ports; and an actuator unit that is fixed to a plane defined by a surface of the passage unit and gives ejection energy to ink in at least one pressure chamber of the plurality of pressure chambers, wherein:

a plurality of closed passages, each having a shape of the individual ink passage being partially closed are formed in the passage unit;

wherein the plurality of ink ejection ports corresponding to the plurality of the pressure chambers are aligned such that when each of the plurality of ink ejection ports is projected in a particular direction onto an imaginary line that is parallel to the plane defined by the surface of the passage unit, the projected points of each of the plurality of ink ejection ports onto the imaginary line align at regular intervals, wherein the particular direction is perpendicular to the imaginary line; and wherein the plurality of closed passages are formed in a region that is enclosed by a contour of the actuator unit when viewed in a plan view, and a length of the actuator unit intersected by an imaginary plane formed perpendicular to the imaginary line varies as the imaginary plane is displaced along the imaginary line.

2. The ink-jet head according to claim 1, wherein:

the plurality of individual ink passages are arranged into one or a plurality of individual ink passage rows extending in one direction, in such a manner that, in each of the individual ink passage rows, positions of neighboring individual ink passages are shifted from each other at a predetermined interval in the one direction; and the closed passage is formed at a position shifted in the one direction outward from the individual ink passage that is located outermost in each of the rows with respect to the one direction.

3. The ink-jet head according to claim 2, wherein the closed passage is formed at a position shifted in the one direction at the predetermined interval outward from the individual ink passage that is located outermost in each of the rows with respect to the one direction.

4. The ink-jet head according to claim 1, wherein the closed passage is, in its portion existing at the same level as the pressure chamber with respect to a direction perpendicular to the plane, not closed.

5. The ink-jet head according to claim 1, wherein the closed passage is closed between a counterpart to an outlet of the common ink chamber in the individual ink passage and a counterpart to an inlet of the pressure chamber in the individual ink passage.

6. The ink-jet head according to claim 5, wherein the closed passage is closed in a counterpart to an outlet of the common ink chamber in the individual ink passage.

7. The ink-jet head according to claim 1, wherein the closed passage is closed between a counterpart to an outlet of the pressure chamber in the individual ink passage and a counterpart to the ink ejection port in the individual ink passage.

8. The ink-jet head according to claim 7, wherein the closed passage is closed in a counterpart to the ink ejection port in the individual ink passage.

9. The ink-jet head according to claim 1, wherein:

the plurality of individual ink passages are regularly formed in an active region that is enclosed by a contour of the actuator unit in a plan view and in addition has its both ends, with respect to a direction of the imaginary line, defined by positions of the two projective points located outermost on the imaginary line; and the closed passage is formed in an outer region that is enclosed by the contour of the actuator unit in a plan view and in addition located outside the active region.

10. The ink-jet head according to claim 9, wherein a boundary between the active region and the outer region exists at a boundary between where a length of the actuator unit intercepted by the imaginary plane is constant regardless of a position of the imaginary plane and where the length varies as the imaginary plane is displaced.

11. The ink-jet head according to claim 9, wherein:

a plurality of the closed passages, each of which is not closed in a counterpart to the ink ejection port in the individual ink passage, are formed in the outer region;

in an ejection face having a plurality of the ink ejection ports formed thereon and extending in parallel to the plane, a plurality of the ink ejection ports and a plurality of openings provided at a plurality of closed passages constitute an ejection port group that corresponds to the actuator unit; and a boundary between the active region and the outer region exists at a boundary between where a length of a region defining the ejection port group intercepted by an imaginary plane that is perpendicular to the imaginary line is constant regardless of a position of the imaginary plane and where the length varies as the imaginary plane is displaced.

12. The ink-jet head according to claim 9, wherein:

the actuator unit includes a common electrode common to the plurality of pressure chambers and kept at a constant potential, a plurality of individual electrodes disposed so as to be opposed to the plurality of pressure chambers, respectively, and supplied with a drive signal for driving the actuator unit, and a piezoelectric layer sandwiched between the common electrode and the plurality of individual electrodes;

the plurality of individual electrodes constitute an individual electrode group on the piezoelectric layer; and a boundary between the active region and the outer region exists at a boundary between where a length of a region defining the individual electrode group intercepted by an imaginary plane that is perpendicular to the imaginary line is constant regardless of a position of the imaginary plane and where the length varies as the imaginary plane is displaced.

13. The ink-jet head according to claim 9, wherein a plurality of the actuator units having the same shape are arranged in one direction on the plane of the passage unit.

14. The ink-jet head according to claim 13, wherein three or more actuator units are fixed to the plane.

15. The ink-jet head according to claim 13, wherein in a plan view the actuator unit has a quadrangular shape with two acute angles.

16. The ink-jet head according to claim 9, wherein:

a plurality of the closed passages are formed in the outer region; and each of a plurality of the closed passages disposed adjacent to a boundary between the active region and the outer region is, in its portion existing at the same level as the pressure chamber with respect to a direction perpendicular to the plane, not closed.

17. The ink-jet head according to claim 1, wherein a plurality of the closed passages are arranged over an entire circumference of the active region.

18. The ink-jet head according to claim 1, wherein:

a plurality of the actuator units are arranged in one direction on the plane of the passage unit, wherein each of outermost actuator units of the plurality of actuator units has the same shape; and the arrangement of the plurality of individual ink passages and the plurality of closed passages in a region within the passage unit opposed to one of the outermost actuator units is the same as that of the plurality of individual ink passages and the plurality of closed passages in a region within the passage unit opposed to the other outermost actuator unit.

19. The ink-jet head according to claim 18, wherein:

the plurality of individual ink passages are arranged into one or more individual ink passage rows extending in one direction; and the imaginary plane is perpendicular to the extending direction of the one or more individual ink passage rows.

20. The ink-jet head according to claim 1, wherein a plurality of the actuator units are arranged in one direction on the plane of the passage unit so as to be symmetric with respect to a predetermined point.

21. The ink-jet head according to claim 1, wherein:

a plurality of the actuator units are arranged in one direction on the plane of the passage unit; and the plurality of individual ink passages are formed between a first boundary and a second boundary, the first boundary being a boundary between where a length of one of outermost actuator units intercepted by the imaginary plane is constant regardless of a position of the imaginary plane and where the length varies as the imaginary plane is displaced, and the second boundary being a boundary between where a length of the other outermost actuator unit intercepted by the imaginary plane is constant regardless of a position of the imaginary plane and where the length varies as the imaginary plane is displaced.

* * * * *